US010914491B2

(12) United States Patent
Boros et al.

(10) Patent No.: US 10,914,491 B2
(45) Date of Patent: Feb. 9, 2021

(54) HEAT PUMP WATER HEATER

(71) Applicant: Rheem Manufacturing Company, Atlanta, GA (US)

(72) Inventors: Jozef Boros, Montgomery, AL (US); Troy E. Trant, Montgomery, AL (US); Hafez Raeisi Fard, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 372 days.

(21) Appl. No.: 15/084,402

(22) Filed: Mar. 29, 2016

(65) Prior Publication Data

US 2017/0284702 A1 Oct. 5, 2017

(51) Int. Cl.

| | |
|---|---|
| ***F24H 4/02*** | (2006.01) |
| ***F25B 30/02*** | (2006.01) |
| ***F25B 1/00*** | (2006.01) |
| ***F25B 1/10*** | (2006.01) |

(52) U.S. Cl.

CPC ..... *F24H 4/02* (2013.01); *F25B 1/005* (2013.01); *F25B 1/10* (2013.01); *F25B 30/02* (2013.01); *F25B 2339/047* (2013.01); *F25B 2400/071* (2013.01)

(58) Field of Classification Search

CPC ... F24H 4/02; F24H 4/04; F24D 17/00; F24D 17/02; F24D 17/0052; F24D 17/0036; F25B 30/06; F25B 30/02; F25B 29/003; F25B 1/005; F25B 1/10

See application file for complete search history.

(56) References Cited

U.S. PATENT DOCUMENTS

| | | | | |
|---|---|---|---|---|
| 4,103,509 | A | 8/1978 | Bottum | |
| 4,909,045 | A * | 3/1990 | Melzi | F24D 3/18 237/2 B |
| 4,947,656 | A * | 8/1990 | Alvisi | F24H 4/02 62/238.6 |
| 5,946,927 | A | 9/1999 | Dieckmann et al. | |
| 6,283,067 | B1 * | 9/2001 | Akkala | F24D 12/02 122/14.22 |
| 7,334,419 | B2 | 2/2008 | Gordon et al. | |
| 7,506,616 | B2 | 3/2009 | Calvert | |
| 7,866,168 | B2 | 1/2011 | Gordon et al. | |
| 8,385,729 | B2 | 2/2013 | Kleman et al. | |
| 2011/0214621 | A1 | 9/2011 | Boros et al. | |
| 2013/0042635 | A1 * | 2/2013 | Nelson | F24H 4/04 62/238.7 |

OTHER PUBLICATIONS

Hepbasli, A., Kalinci, Y., A Review of Heat Pump Water Heating Systems, Renewable and Sustainable Energy Reviews (2008), doi:10.1016/j.rser.2008.08.002.

* cited by examiner

*Primary Examiner* — Tavia Sullens
(74) *Attorney, Agent, or Firm* — Troutman Pepper Hamilton Sanders LLP

(57) ABSTRACT

A heat pump water heater has a tank, a burner in communication with a fuel source, a flue, and a heat pump system. The heat pump system has a refrigerant path, at least a portion of which forms an evaporator in thermal communication with the flue. Another portion of the refrigerant path is in thermal communication with the water tank volume so that heat transfers from the refrigerant to the water tank volume.

13 Claims, 9 Drawing Sheets

HEAT PUMP WATER HEATER

BACKGROUND OF THE PRESENT INVENTION

Various apparatus and methods have been proposed for supplementing heat applied to water in a water heater tank by means of a heat pump that acquires heat from air ambient to the water heater and conveys the acquired heat to the water tank water via a heat exchanger.

In a prior art system illustrated in FIG. 1A, for example, a water tank 10 comprises a metal, for example steel, or polymer tank 12 that encloses a volume of water therein and that is, in turn, enclosed by an outer metal housing 18. Tank 12 receives cold water from a cold water inlet 14 and expels hot water from a hot water outlet 16. Two heating elements (not shown) are secured within harnesses (not shown) attached to and extending through outer housing 18 and that extend and attach to the outer surface of tank 12. Each heating element attaches to a respective harness and extends through the wall of tank 12 into the tank's interior volume. An electrical power source provides electric current to each heating element under the control of the water heater's control system so that the electric current passes through the resistive elements, causing their temperature to rise and thereby causing the resistive elements to contribute heat to water within the tank interior volume. The control system actuates the resistive heating elements (i.e., provides power to them) in response to the output of one or more temperature sensors attached to the exterior of tank 12 or extending therethrough that provide signals to the control system indicating the temperature of water within the tank volume. In particular, the control system actuates the heating elements when the tank water temperature is low and deactivates the one or more heating elements when the tank water temperature reaches a predetermined upper set point.

Cold water from inlet 14 is attached to a private or public water system that provides water under pressure to end user water systems such as tank 10. Hot water outlet 16 is attached to a hot water piping system within a residential or commercial building that delivers hot water to faucets, appliances, and other equipment that draw hot water upon actuation of an associated valve. When those valves are open, causing low pressure at hot water outlet 16, water pressure within tank 12 (maintained by pressure applied by the water source at cold water inlet 14) expels heated water through outlet 16.

A refrigerant conduit 18 conducts refrigerant through a refrigerant path that encompasses a condenser coil portion 22, an expansion valve 24, an evaporator coil 26, and a compressor 28. Condenser coil 26 comprises a portion of refrigerant conduit 20 that wraps around the exterior of tank 12, inside the enclosure of outer tank housing 18. Following condenser coil 26, refrigerant conduit 20 leads to expansion valve 24. As should be understood, the expansion valve receives a fluid input at a high pressure and, depending on the settings within the valve, outputs the fluid at a lower pressure, allowing the pressurized refrigerant entering the valve to drop in pressure in the coil of evaporator 26 and change phase from a liquid to a gas. As should also be understood, compressor 28 is a pump that additionally provides pressure to refrigerant flowing through the refrigerant path to thereby maintain the refrigerant flowing through the complete closed loop that the path defines.

More specifically, compressor 28 pumps the gaseous refrigerant received from evaporator 26 forward, increasing the refrigerant's pressure and temperature and causing the now-hotter refrigerant gas to flow through condenser coil 22. The hot refrigerant is now separated from water within tank 12 by the refrigerant conduit line wall and the wall of tank 12, both of which are metallic and therefore relatively heat-conductive. Thus, as the refrigerant travels through the length of condenser coil 22, the refrigerant transfers heat through these walls to the cooler water within the inner tank volume. The refrigerant thereby acts as a heat source that supplements the resistive heating elements.

As refrigerant flows through condenser 22, it changes phase from gas to liquid. Still under the pressure provided by compressor 28, however, the now-liquid refrigerant flows from condenser 22 to expansion valve 24, which drops the liquid refrigerant's pressure as it enters evaporator coil 26. A fan 30 is actuated concurrently with compressor 28 and is positioned adjacent holes in housing 18 so that the fan pushes an output air stream 32 from a volume 34 within the upper portion of housing 18, across evaporator coil 26, through the holes, and out to an exterior area ambient to the water tank. Outer housing 18 defines a second set of holes 36 on the opposite side of volume 34 from the holes adjacent to fan 30 and evaporator 26, so that fan 30 also draws an input air stream 38 into volume 34. Thus, fan 30 draws an airflow from outside tank 10, into volume 34, and across compressor 28, through evaporator coil 26, and out of tank 10 at airflow 32. Particularly where tank 10 is in a building, ambient air 38 is at a warm temperature, but as the airflow passes over compressor 28 during the compressor's operation, the airflow draws further heat generated by the compressor. Within evaporator 26, the now-lower pressure refrigerant draws heat energy from the air flow over coil 26 and transitions to a gaseous phase. The now-warmer gaseous refrigerant discharged from evaporator coil 26 then returns to compressor 28 via a suction portion 40 of refrigerant line 20, and the cycle repeats.

As is apparent from the discussion above regarding water tank 10 as illustrated in FIG. 1A, condenser 22 forms part of a heat exchanger that transfers heat between the refrigerant of conduit line 20 and the water stored in the inner volume of tank 12. In a prior art configuration illustrated in FIG. 1B, condenser 22 is part of a heat exchanger that is separate from tank 12. In this arrangement, tank 12, compressor 28, evaporator 26, fan 30, the airflow, and conduit line 20 operate as discussed above with respect to FIG. 1A, except that the portion of conduit line 20 forming condenser coil 22 does not wrap around the exterior of tank 12. Instead, coil 22 is housed in a middle chamber 42 disposed between upper volume 34 and the lower volume that encloses tank 12. A water line 42 extends from the inner volume of tank 12 to and from a heat exchanger in which condenser coil 22 is also disposed. A pump (not shown) is provided in line 42 to pump the tank water to and from the heat exchanger. The refrigerant line of coil 22 and the water line of coil 42 are adjacent to one another in the heat exchanger, so that the refrigerant flowing through coil 22 contributes heat to the water flowing through line 42 across the walls of conduit 20 and conduit 42. Otherwise, the system illustrated in FIG. 1B operates in a manner as does the system illustrated in FIG. 1A.

Other heat exchange arrangements are possible, for example as discussed at A. Hepbasli and Y. Kalinci, *A Review of Heat Pump Water Heating Systems*, Renew. Sustain. Energy Rev. (2008).

SUMMARY OF THE INVENTION

A heat pump water heater according to an embodiment of the present invention has a tank defining a water tank volume for retaining water and a burner in communication with a fuel source and proximate the tank so that combustion of fuel from the source at the burner generates heat that transfers to the water tank volume. A flue defines a flue volume extending from an area in which the burner is disposed to an area ambient the tank so that the flue conveys exhaust gas resulting from the combustion to the ambient area. A heat pump system has a refrigerant path having a first portion in thermal communication with the flue so that heat transfers from the exhaust gas in the flue volume to refrigerant flowing through the first portion, and a second portion in thermal communication with the tank so that heat transfers from refrigerant flowing through the second portion to the water tank volume when refrigerant flows through the second portion and the water tank volume retains water. A pump is disposed in the refrigerant path and is actuatable to move refrigerant through the refrigerant path.

A heat pump water heater according to another embodiment of the present invention has a tank that defines a water tank volume for retaining water. A burner is in communication with a fuel source and is proximate the tank so that combustion of fuel from the source at the burner generates heat that transfers to the water tank volume. A flue defines a flue volume extending from an area in which the burner is disposed to an area ambient the tank so that the flue conveys exhaust gas resulting from the combustion to the ambient area. A heat pump system has a fan actuatable to move air in an air flow path. A refrigerant path has a first portion that passes through the air flow path, a second portion in thermal communication with the flue so that heat transfers from the exhaust gas in the flue volume to refrigerant flowing through the second portion, and a third portion in thermal communication with the tank so that heat transfers from refrigerant flowing through the third portion to the water tank volume when refrigerant flows through the third portion and the water tank volume retains water. A pump is disposed in the refrigerant path and is actuatable to move refrigerant through the refrigerant path.

A heat pump water heater has a tank defining a water tank volume for retaining water and a burner in communication with a fuel source and proximate the tank so that combustion of fuel from the source at the burner generates heat that transfers to the water tank volume. A flue defines a flue volume extending from an area in which the burner is disposed to an area ambient the tank so that the flue conveys exhaust gas resulting from the combustion to the ambient area. A heat pump system has a fan actuatable to move air in an air flow path and a refrigerant path having a first portion comprising a tubing coil disposed in the air flow path, a second portion comprising a section of tubing adjacent the flue so that heat transfers from the exhaust gas in the flue volume to refrigerant flowing through the second portion, and a third portion comprising a section of tubing adjacent the tank so that heat transfers from refrigerant flowing through the third portion to the water tank volume when refrigerant flows through the third portion and the water tank volume retains water. Refrigerant flows through an expansion valve upstream from the tubing coil to evaporate in the tubing coil. A pump is disposed in the refrigerant path downstream from the tubing coil and is actuatable to move refrigerant through the refrigerant path.

In a method of constructing a heat pump water heater, the heat pump water heater has a tank of a predetermined size that defines a water tank volume for retaining water, a burner of a predetermined power consumption, the burner being in communication a fuel source and proximate the tank so that combustion of fuel from the source at the burner generates heat that transfers to the water tank volume, and a flue defining a flue volume extending from an area in which the burner is disposed to an area ambient the tank so that the flue conveys exhaust gas resulting from the combustion to the ambient area. A refrigerant path is selected that has a first portion in thermal communication with the flue so that heat transfers from the exhaust gas in the flue volume to refrigerant flowing through the first portion, and a second portion in thermal communication with the tank so that heat transfers from refrigerant flowing through the second portion to the water tank volume when refrigerant flows through the second portion and the water tank volume retains water, and a pump is selected that is disposed in the refrigerant path and actuatable to move refrigerant through the refrigerant path, so that the heat pump water heater has an energy factor greater than 1.0.

The accompanying drawings, which are incorporated in and constitute a part of this specification, illustrate one or more embodiments of the present invention.

BRIEF DESCRIPTION OF THE DRAWINGS

Aspects of the present invention can be better understood with reference to the following drawings. The components in the drawings are not necessarily to scale. An enabling disclosure of the present invention, including the best mode thereof, is set forth in the specification, which makes reference to the appended drawings, in which.

DETAILED DESCRIPTION OF PREFERRED EMBODIMENTS

Reference will now be made in detail to embodiments of the invention, one or more examples of which are illustrated in the accompanying drawings. Each example is provided by way of explanation, not limitation. In fact, it will be apparent to those skilled in the art that modifications and variations can be made in such examples without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of the water heater, such as but not limited to "vertical," "horizontal," "upper," "lower," "above," or "below," refer to directions and relative positions with respect to the water heater's orientation in its normal intended operation, as indicated in FIGS. 2, 5, 7 and 9. Thus, for instance, the terms "vertical" and "upper" refer to the vertical orientation and relative upper position in the perspective of FIGS. 2, 5, 7 and 9, and should be understood in that context, even with respect to a water heater that may be disposed in a different orientation.

Further, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "and" as used in this application and the appended claims should generally be construed to mean "one or more" unless specified otherwise or clear from the context to be directed to a singular form. Throughout the specification and claims, the following terms takes at least the meanings explicitly associated herein, unless the context dictates otherwise. The meanings identified below do not necessarily limit the terms, but merely provide a illustrative examples for the terms. The meaning of "a," "and," and "the" may include plural references, and the meaning of "in" may include "in" and "on." The phrase "in one embodiment," as used herein, does not necessarily refer to the same embodiment, although it may.

Figure 1A:
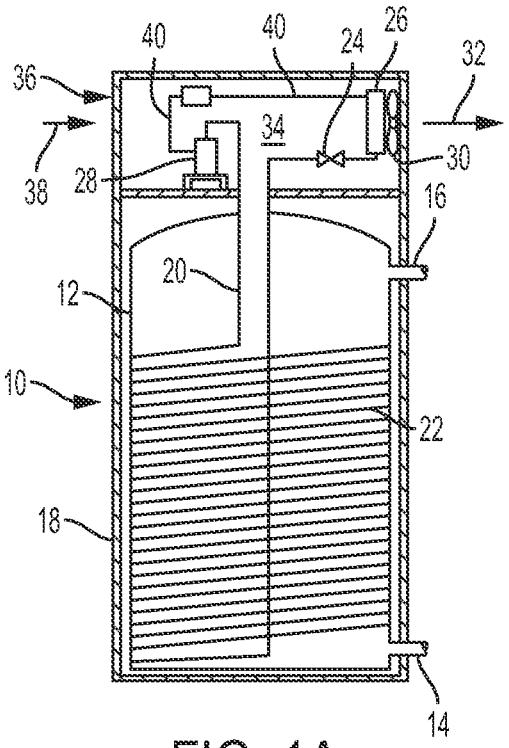
FIG. 1A PRIOR ART
FIG. 1A is a schematic view of a heat pump water heater system of the prior art.
Figure 1B:
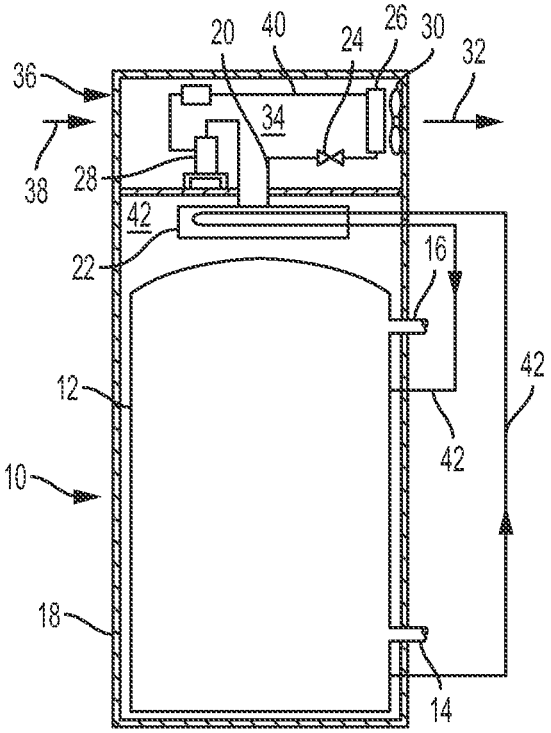
FIG. 1B PRIOR ART
FIG. 1B is a schematic view of a heat pump water heater system of the prior art.
Figure 2:
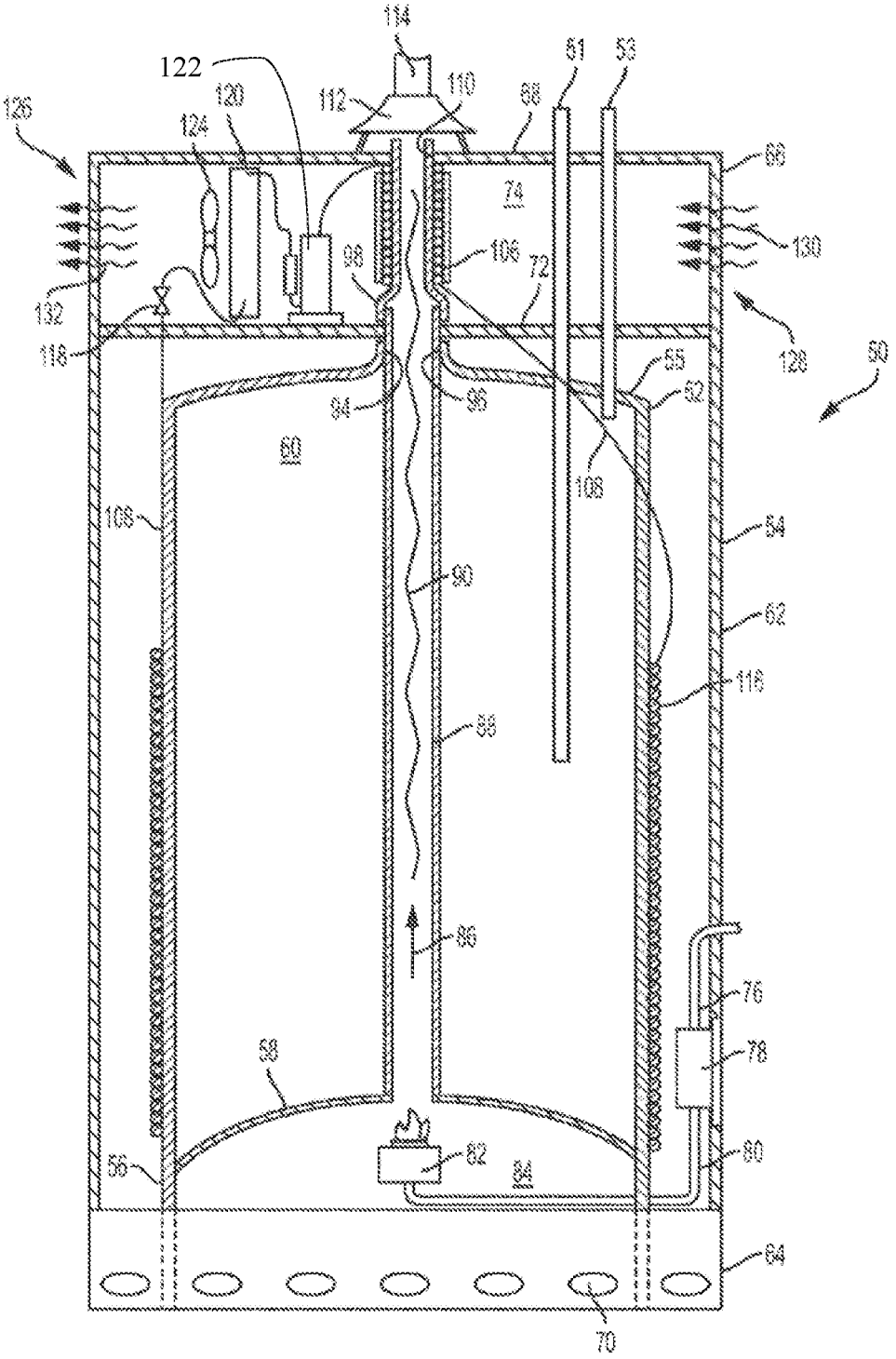
FIG. 2 is a schematic view of a heat pump water heater system of an embodiment of the present invention.

Referring now to FIG. 2, a water heater 50 includes a vertically oriented, generally cylindrical water tank body 52 enclosed by an outer housing 54. Body 52 is defined by a domed top wall, or head, portion 55, a cylindrical side wall portion 56, and a domed bottom wall portion 58. Side body wall 56, top wall 55, and bottom wall 58 generally define an interior volume 60 for storing water therein. Side wall 56, top wall 55, and bottom wall or floor 58 may be formed from materials common to the construction of water heaters, for example a carbon steel outer wall layer with a glass or porcelain enamel inner surface, or uncoated stainless steel.

Outer housing 54 is also made of a suitable metal, such as carbon steel. The outer housing completely surrounds tank body 52 and is comprised of a main cylindrical portion 62, a bottom cylindrical skirt portion 64, an upper cylindrical skirt portion 66, and a closed circular top portion 68. Skirt portion 64 defines a plurality of through-holes 70 about its perimeter to allow ingress of ambient air beneath floor 58 of water tank body 52 to provide air for combustion of gas at a burner, as described below. In certain embodiments, the volume within lower skirt 64 has no top, so that this volume is open to a volume surrounded by bottom portion 58, thereby allowing free access of air within the volume of skirt 64 to reach the burner.

Outer housing 54 also includes a circular interior shelf 72 that sits atop center body section 62 of the outer housing and provides a platform for certain components of the heat pump system of water heater 50, as described below. Shelf 72 thereby separates the lower interior volume of outer housing 54, which encloses water heater body 52, from an upper volume 74 of outer housing 54, which encloses such heat pump components.

A cold water inlet pipe 51 extends through the top of the water heater outer housing, through shelf 72, and through domed top portion 55 into interior tank volume 60. Pipe 51 attaches to a fitting (not shown) that connects pipe 51 to a cold water source, e.g. a building cold water pipe connected to a municipal water service line. A hot water outlet pipe 53 extends from interior tank volume 60, through domed top wall portion 55, shelf 72 and the top of the outer housing. The exterior end of hot water pipe 53 attaches to a building hot water line (not shown), that in turn leads to valves of appliances, faucets, or other devices within the building that conduct or use hot water. Cold water inlet pipe 51 extends deeper into tank interior volume 60 than does hot water outlet pipe 53, in that the tank's warmer water is higher in the tank than the colder water, as should be understood.

An external gas line 76 extends through exterior housing 54 to a control gas valve 78 that conducts incoming gas to an internal gas line 80 and thereby to a burner 82 within a burner box 84 encompassed by bottom wall portion 58 of tank body 52 so that burner 82 ignites the incoming gas to produce heat in a combustion chamber 84. Ambient air flowing from outside housing 54 flows through holes 70 into an area bounded by skirt 64 beneath combustion chamber 84. This volume may openly communicate with combustion chamber 84, or may otherwise fluidly communicate with combustion chamber 84 via a horizontal perforated floor that separates combustion chamber 84 from the volume enclosed by the skirt. In either event, air from the volume enclosed by skirt 64 flows upwardly into combustion chamber 84, where it contributes to combustion at burner 82.

Hot flue gas, indicated at 86, rises from the combustion chamber through a flue that extends through bottom wall 58 so that an internal volume of the flue is open to and communicates with the volume of combustion chamber 84. Flue gas 86 delivers heat to the wall of flue 88 as the gas rises. In addition, a plurality baffle fins 90 disposed within the flue's interior slow the flow of flue gas 86 through flue 88, thereby increasing the time the flue gas is in contact with the flue wall and the amount of heat the flue gas contributes to the wall and thereby to water within volume 60. Fins 90 may be connected to the flue wall so that heat acquired by the fins also transfers to the flue wall, adding additional heat to the flue and, therefore, the water in volume 60.

Flue pipe 88 extends entirely through the interior of tank volume 60 and through the top of the tank at the center of domed top wall 55. As should be understood, the intersection of flue 88 with floor 58 and top wall 55 are sealed to maintain the tank and inner tank volume 60 in a fluid-tight state.

Figure 4:
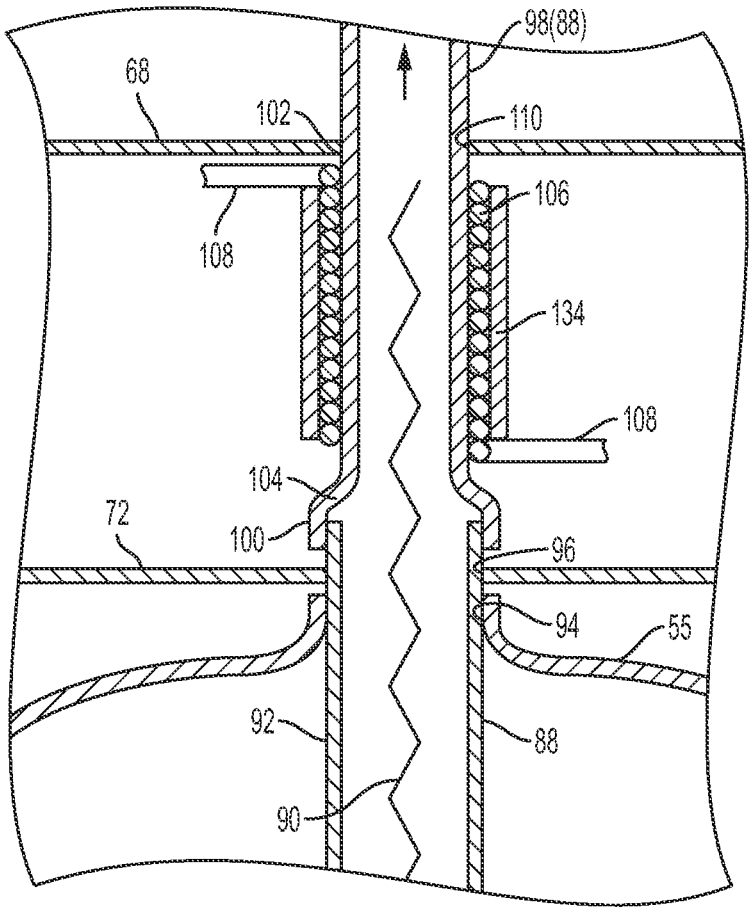
FIG. 4 is a schematic illustration of a component of the heat pump water heater system as in FIG. 2.

FIG. 4 provides a more detailed illustration of flue pipe 88 as it extends through top wall 55 of tank 52 and intermediate shelf 72 and top plate 68 of outer housing 54. Flue pipe 88 includes a main portion 92 that extends from the tank bottom (not shown in FIG. 4) to tank top wall 55 and through a sealed circular bore 94 defined thereby. Portion 92 also extends through intermediate shelf 72 via a circular bore 96, which may also be sealed. A heat recovery assembly tube 98 includes a flared bottom portion 100 that receives the distal end of main flue portion 92 and that is secured thereto by adhesive, screws, bolts and/or other mechanisms. An elongated top portion 102 extends upward from flared bottom portion 100 from a countersunk transition flange 104 so that top portion 102 has a diameter of appropriate size to cooperate with a vent system of the building in which the water heater is located. A coil 106 of a refrigerant line 108 of a heat pump system wraps around upper tube portion 102 to receive heat from the flue gas passing through the flue, as discussed herein. Above coil 106, upper tube portion 102 extends through a circular bore 110 of exterior housing top plate 68 to a draft hood 112 (FIG. 2). As should be understood, draft hood 112 receives the flue gas and directs the flue gas to a gas vent pipe 114 by which the flue gas is vented to an exterior area. A slight gap exists between the upper end of upper tube portion 102 and draft hood 112. As the heat flue gas flows upward out of the upper tube portion 102 into draft hood 112, cooler ambient air drawn into the flow dilutes and cools the flue gas.

Returning to FIG. 2, refrigerant coil 108 is made, in this example, of an aluminum conduit line that extends downward from its wrap around flue pipe 88, through intermediate shelf 72, to wrap tightly around at least a portion of side body 56 of water tank 52, forming a coil/condenser 116. From coil 116, refrigerant line 108 continues to an expansion valve 118 upstream from an evaporator coil 120. The construction of evaporators should be understood and may vary. In one example, the evaporator is a length of coiled tubing with fins attached to the tubing to radiate heat, acquired from warm air flowing over the fins, to the coil. In any construction, however, the refrigerant path through the evaporator may be considered to be a part of refrigerant line 108. In one embodiment, the return line portion of the refrigerant line from coil 116 runs between the coil and the side of tank 52, but it may also run outside the coil. From evaporator 120, refrigerant line 108 continues to a compressor 122 of the heat pump system and, from the compressor, to the wrap around flue pipe 88, thereby completing a continuous fluid path.

A fan 124 is disposed in volume 74 between evaporator coil 120 and an opening, e.g. a set of holes, 126 in the side of upper skirt portion 66 of outer housing 54. An opening, e.g. a set of holes, 128 is defined in skirt portion 66 opposite holes 126 across volume 74 so that compressor 122 is between evaporator 120 and holes 128, and so that compressor 122 and evaporator 120 are between fan 124 and holes 128. Accordingly, when fan 124 is activated, the fan draws a stream 130 of ambient air from an area exterior to the water heater through holes 128 into volume 74. The air flows over compressor 122, thereby acquiring additional heat therefrom, to and about the coil of evaporator 120, through the fan, and out holes 126, as indicated at 132.

As explained below, it is desired in this embodiment for refrigerant flowing through coil 106 of the heat pump system to acquire heat from flue gas in flue pipe 88 (heat recovery tube 98 being considered part of flue pipe 88). Accordingly, and referring again to FIG. 4, to prevent air flow 130/132 (FIG. 2) from removing heat from coil 106, a layer of insulation 134 may be wrapped around the conduit line of coil 106. Alternatively, the refrigerant line that forms coil 106 may itself be insulated on an outward facing side, though not on the surface that engages flue pipe 88/98.

The heat pump system's compressor 122 (i.e. a pump) pumps a gaseous refrigerant, for example a hydro-fluorocarbon refrigerant such as R-410A, R-407C, R-134A or other suitable refrigerant, forward from the compressor, increasing the refrigerant's pressure and temperature and causing the now-hotter refrigerant gas to flow through conduit 108 to coil 106 wrapped about flue pipe 88. The conduit line in coil 106 directly abuts the wall of flue pipe 88, so that the refrigerant is separated from the hot flue gas in flue pipe 88 by the walls of the refrigerant conduit and the flue pipe. These walls, being made of carbon steel, stainless steel, or other suitable metal for the flue pipe and being made of aluminum for the tubing coil, are good conductors of heat. The refrigerant, while hot, is nonetheless cooler than the flue gas in pipe 88. Thus, flue gas within pipe 88/98 contributes heat to the refrigerant flowing through coil 106 (in certain embodiments, by about 40° F., although it should be understood that the temperature differential may vary), so that coil 106 and upper portion 102 of heat recovery tube 98 thereby form a heat exchanger. It will be understood that the refrigerant's acquisition of heat from the flue gas increases its pressure, thereby increasing the work done by the compressor in moving the refrigerant entirely through the closed-loop refrigerant path, and the compressor may be selected of a size and power to accommodate the predictable load. From wrap 106, the refrigerant conduit continues to condenser coil 116. As noted above, the refrigerant conduit of coil 116 directly abuts the outer surface of tank body 52, so that the water within tank volume 60 and refrigerant flowing through the refrigerant conduit are separated only by the walls of tank 52 and conduit 108. The walls of tank 52 and conduit 108, being made of steel and aluminum, respectively, are good conductors of heat. Thus, the refrigerant flowing through coil 116 (and 106) contributes heat to water within tank 52, via the tank and refrigerant conduit walls.

As the refrigerant moves through condenser coil 116, it condenses to liquid phase. Still under pressure provided by compressor 122, the now-liquid refrigerant flows from the output of condenser 116 to expansion valve 118. The expansion valve drops the pressure of the liquid refrigerant as it enters evaporator coil 120. Within the evaporator, the refrigerant transitions to gaseous phase, drawing heat energy from air flowing over the evaporator coil, the heat being contributed by the environment ambient to water heater 50 and by compressor 122. The removal of heat from the air flowing through the evaporator cools the air output from the system, as indicated at 132, and in some embodiments the cool air may be captured and directed to an air-conditioning system used within the building in which water heater 50 is located. The now-warmer gaseous refrigerant discharged from evaporator 120 then returns to compressor 122 via a suction line of refrigerant conduit line 108 that extends betweens evaporator 120 and compressor 122, and the cycle repeats.

An electronic control system (not shown, but present in the systems of FIGS. 2, 5, 7, and 9) controls the various functions of the heat pump water heater and operates the various controlled components thereof. The control system may comprise a programmable logic controller (PLC) or other computer that operates as a general system controller for heat pump water heater 50. Housed, for example, within a compartment disposed within outer housing 54, the PLC communicates with and controls (through suitable electrical wired or wireless connections, relays, power sources, and/or other electromechanical connections, as should be understood in this art) the actuation and operation of the controllable components and sensors described herein, including but not limited to the compressor, fan, water pump (if present), water temperature sensor, gas control valve, burner, and all other electrically controlled valves, relays, and components. As such, the control system communicates with and controls the operative components of water heater 50, including the compressor, to thereby control refrigerant flow. The reference to connections between the control system and each of the components of water heater 50 encompass such communications and control. Such communication may also encompass communication between the control system and a temperature sensor ambient to water heater 50 that provides a signal to the control system corresponding to temperature of the environment ambient to water heater 50.

It will be understood from the present disclosure that the functions ascribed to the control system may be embodied by computer-executable instructions of a program that executes on one or more PLCs or other computers that operate(s) as the general system controller for water heater 50. Generally, program modules include routines, programs, components, data structures, etc., that perform particular tasks and/or implement particular abstract data types. Moreover, those skilled in the art will appreciate that the systems/methods described herein may be practiced with various controller configurations, including programmable logic controllers, simple logic circuits, single-processor or multi-processor systems, as well as personal computers, hand-held computing devices, microprocessor-based or programmable consumer or industrial electronics, and the like. Aspects of these functions may also be practiced in distributed computing environments, for example in so-called "smart" arrangements and systems, where tasks are performed by remote processing devices that are linked through a local or wide area communications network to the components otherwise illustrated in the Figures. In a distributed computing environment, programming modules may be located in both local and remote memory storage devices. Thus, the control system may comprise a computing device that communicates with the system components described herein via hard wire or wireless local or remote networks. A controller that could effect the functions described herein could include a processing unit, a system memory and a system bus. The system bus couples the system components including, but not limited to, system memory to the processing unit. The processing unit can be any of various available programmable devices, including microprocessors, and it is to be appreciated that dual microprocessors, multi-core and other multi-processor architectures can be employed as the processing unit.

Software applications may act as an intermediary between users and/or other computers and the basic computer resources of the electronic control system, as described, in suitable operating environments. Such software applications include one or both of system and application software. System software can include an operating system that acts to control and allocate resources of the control system. Application software takes advantage of the management of resources by system software through the program models and data stored on system memory. The control system may also, but does not necessarily, include one or more interface components that are communicatively coupled through the bus and facilitate an operator's interaction with the control system. By way of example, the interface component can be a port (e.g., serial, parallel, PCMCIA, USC, or FireWire) or an interface card, or the like. The interface component can receive input and provide output (wired or wirelessly). For instance input can be received from devices including but not limited to a pointing device such as a mouse, track ball, stylus, touch pad, key pad, touch screen display, keyboard, microphone, joy stick, gamepad, satellite dish, scanner, camera, electromechanical switches and/or variable resistors or other adjustable components, or other components. Output can also be supplied by the control system to output devices via the interface component. Output devices can include displays (for example cathode ray tubes, liquid crystal display, light emitting diodes, or plasma) whether touch screen or otherwise, speakers, printers, and other components. In particular, by such means, the control system receives inputs from, and directs outputs to, the various components with which the control system communicates, as described herein.

In general, the control system operates gas control valve 78 and burner 82 in response to signals from a temperature sensor (not shown) within water volume 60 or attached to the exterior of tank body 52 opposite the water in volume 60. The control system has a lower and an upper set point. When the control system detects, via the signal from the temperature signal, that the water in volume 60 is below the high set point, it does not actuate gas control valve 78 and burner 82 until the water temperature reaches the low set point. When the water reaches the low set point, the control system actuates gas control valve 78 to provide gas to, and ignites, burner 82, thereby providing heat to combustion chamber 84 and the flue pipe, which is in turn transferred to the water in volume 60 through the tank bottom wall and the flue pipe wall. The control system maintains actuation of the burner until the water temperature reaches the high set point, at the occurrence of which the control system deactivates the burner and the gas control valve, keeping those components inactive until the water again reaches the low set point.

In one embodiment, the control system actuates the heat pump, i.e. by actuating compressor 122 to move refrigerant through the closed refrigerant path and actuating fan 124, simultaneously with actuation of gas control valve 78 and burner 82. That is, when the burner is being actuated to provide heat to the water in volume 60, the heat pump is simultaneously actuated to provide heat to the water from the refrigerant. It should be understood, however, that many variations can be made in the heat pump's operation and thereby in the control system's control of the heat pump. For example, it will be appreciated in view of the present disclosure that as the water temperature increases, heat transfer from the refrigerant to the water decreases, resulting in higher refrigerant temperature, higher work required of the heat pump, and lower heat pump efficiency. Accordingly, in another embodiment, the control system actuates the heat pump simultaneously with actuation of gas control valve 78 and burner 82 at the water's low set point but deactivates the heat pump at a predetermined water temperature below the high set point at which the heat pump's efficiency falls below a desired level. This water temperature can be determined through calibration of a given system, as should be understood in view of the present disclosure. In a further embodiment, the control system monitors temperature from a temperature sensor in an area ambient to the heat pump water heater and deactivates the heat pump when the ambient temperature drops below a predetermined minimum temperature threshold. As should be understood in view of the present disclosure, the heat pump's efficiency may drop with cooler ambient temperature in that the air flow over the evaporator contributes less heat to the refrigerant. Given a particular heat pump water heater configuration, if it is determined that heat pump efficiency drops to an undesirable level below a certain ambient temperature, the control system may be configured to deactivate the heat pump upon detecting an ambient temperature below that threshold. In a still further embodiment, the control system periodically or otherwise intermittently monitors the gas flow through valve 78 and the temperature of water in volume 60, determining a ratio corresponding to the system's energy factor. The control system repeatedly compares the dynamically determined energy factor against a user-defined energy factor threshold and maintains the heat pump in operation simultaneously with actuation of gas control valve 78 and burner 82 as long as the dynamically determined energy factor is above the user defined threshold. When, or if, the measured actual energy factor drops below the user defined threshold, or when the water temperature reaches the high set point, whichever occurs first, the control system deactivates the burner and the gas control valve.

Figure 3:
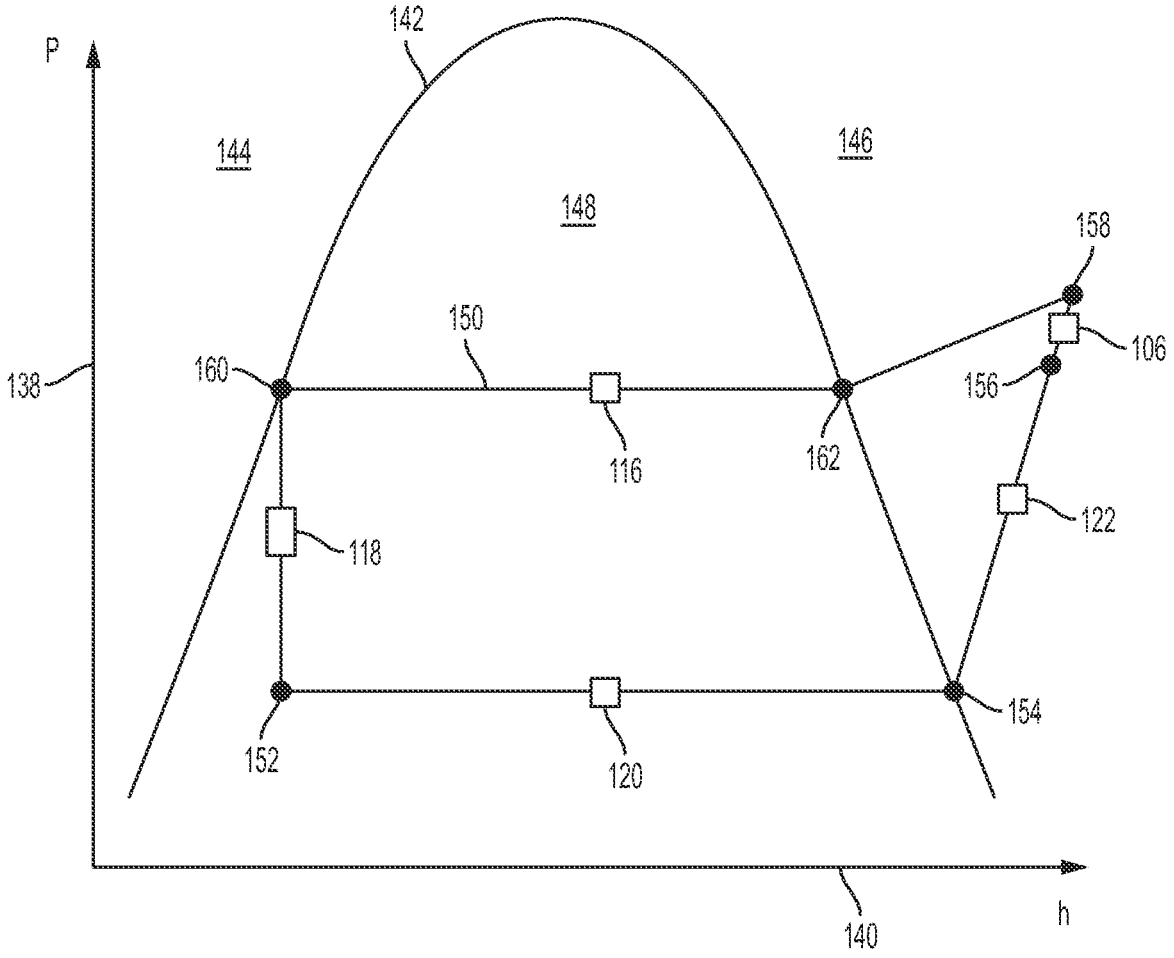
FIG. 3 is a graphical illustration of a pressure-enthalpy diagram illustrating operation of the heat pump water heater system as in FIG. 2.

FIG. 3 illustrates the operation of heat pump water heater 50 in terms of an ideal pressure-enthalpy graph, where vertical axis 138 describes pressure and horizontal axis 140 describes enthalpy, of the refrigerant flowing through conduit 108. To the left of a curve 142, as indicated at 144, the refrigerant is entirely in liquid phase. To the right of curve 142, as indicated at 146, the refrigerant is entirely in gaseous phase. Within the curve, as indicated at 148, the refrigerant is a mix of saturated liquid (i.e. about to transition to gas) and saturated vapor (i.e. about to condense to liquid). A closed curve 150 describes the refrigerant's pressure/enthalpy state as the refrigerant travels through the closed refrigerant path discussed above with respect to FIG. 2. As noted, curve 150 is an ideal curve, presented for purposes of explanation, and it will be understood that the actual curve corresponding to the system's actual operation will vary from the ideal case.

For example, a point 152 on curve 150 corresponds to a position in the refrigerant path when the refrigerant leaves expansion valve 118. Here, the refrigerant has the same enthalpy as when it entered the valve, but its pressure has dropped. Maintaining constant enthalpy, its volume increases. Because the refrigerant's energy, or heat, now occupies a larger volume, the refrigerant's temperature is lower. Being at a lower pressure, the refrigerant more readily evaporates, meaning that it more readily accepts energy or latent heat, from the air flow. As the refrigerant moves through evaporator 120, and correspondingly moving on curve 150 between points 152 and 154, the refrigerant completely evaporates to gaseous form. The refrigerant, in an entirely gaseous phase at point 154 and reaching a temperature near the air temperature in the air flow, receives little or no sensible heat from the air flow as the refrigerant continues to flow through the evaporator. Thus, the refrigerant remains at the enthalpy level corresponding to point 154 on curve 150 until the refrigerant exits evaporator 120, flows through the following refrigerant path (through which the refrigerant loses some amount of energy) and reaches the compressor.

Compressor 122 significantly increases the refrigerant's pressure, as indicated by curve 150 in the transition from point 154 to point 156. The compressor reduces the refrigerant's volume and increases its temperature, and the compressor's operation to accomplish this work requires an amount of energy input without a correspondingly high enthalpy increase, with the result that the compressor is a source of system inefficiency. The increase in enthalpy from point 156 to point 158, however, occurs as the refrigerant moves through coil 106, drawing heat from the flue gas and thereby experiencing thermal compression. This increase occurs without additional input and energy to the water heater system, in that the flue gas energy would have otherwise been expelled from the system as waste.

From flue pipe coil wrap 106, the refrigerant flows through the refrigerant path to condenser coil 116. The refrigerant loses some heat in that travel, though relatively little. In that regard, insulation may be provided around the tubing to reduce this effect. When the tubing reaches and abuts the water heater wall, the much lower temperature of the tank water, given the thermal conductivities of the tank wall and the tubing wall, causes heat transfer from the refrigerant to the tank water. This is reflected in curve 150 in the enthalpy drop between points 158 and 160, with the refrigerant beginning to condense into liquid at point 162. Between points 162 and 160, the refrigerant contributes latent heat to the water as it changes phase from gas to liquid, and during this process maintains a constant pressure. It will be noted that as the refrigerant contributes heat to the tank water while changing phase (between points 162 and 160), refrigerant pressure remains constant. At point 160, the refrigerant temperature is slightly below the water temperature, and further energy contribution from the now-fully liquid refrigerant does not occur or only slightly occurs. The refrigerant then travels to the expansion valve, to reduce its pressure and thereby facilitate its acceptance of energy from the air flow, and the cycle continues.

A water heater's energy factor (EF) is a measure of the amount of hot water produced per unit of fuel consumed. In the embodiment described with respect to FIGS. 2-4, the fuel consumed is the gas directed to and consumed at the burner and electricity consumed by the fan and compressor. In general, the heat pump increases the water heater's EF because the amount of heat it removes from the air flow and contributes to the tank water outweighs the incremental system energy consumption added by the fan and the compressor. This effect is reflected in FIG. 3 by the enthalpy increase between points 156 and 158, when the refrigerant is in thermal compression, where the refrigerant draws energy from the flue gas at no additional system energy contribution, other than by the fan and by the compressor (due to the incremental increased energy needed to push the refrigerant through the cycle given the increased temperature of, i.e. increased energy added to, the refrigerant by the flue gas).

The systems described herein are hybrid systems, in that they comprise two or more sub systems that work together in performing common work. In this instance, the gas fired heat pump water heater is a hybrid system in that the gas-fired burner works with the heat pump in providing heated water. The efficiency of any hybrid system can be calculated based on the efficiency of its sub systems. Therefore the heat pump water heater's energy factor ($EF_{overall}$) can be expressed as the burner's energy factor ($EF_{burner}$, which will be less than 1.0) and the heat pump's energy factor ($EF_{HP}$, which may be great than 1.0):

$$EF_{overall}=(X)*(EF_{burner})+(Y)*(EF_{HP}),$$

Where X and Y are the respective percentage contributions of the burner and the heat pump to the overall system power consumption. It should be understood that "contribution" may refer to the contributions of heat to the tank water by the burner and the heat pump, but can also be considered in terms of the burner's and the heat pump's contribution to the energy consumed fuel.

For instance, if the unit only uses the gas-fired burner to heat the water (gas only mode), X is 1, and Y is 0. Hence the overall energy factor is given by:

$$EF_{overall}=1*(0.8)+0*3.2=0.8.$$

Where the system operates in heat pump only mode, X=0, and Y=1, and overall energy factor is equal to heat pump EF. Suppose, for example, that the heat pump water heater consumes 10 kilo-British Thermal Units per hour (kBTU/hr) when both the water heater and the heat pump operate, and that in such hybrid operation the gas water heater consumes 5.0 kBTU/hr and the heat pump consumes 5.0 kBTU/hr (i.e. each contributes 0.50 of the overall 10 kBTU). In this case, the overall system energy factor, again assuming 0.8 EF for the water heater and 3.2 EF for the heat pump, is:

$$EF_{overall}=0.50*(0.8)+0.50*3.2=2.0.$$

In operation, the heat pump water heater works mostly in the hybrid mode. This means that heat pump and gas-fired burner are contributing to the system at the same time. As apparent in the first equation above, it is possible to vary the overall system EF by varying the relative contributions to fuel consumption made by the heat pump and the gas-fired water heater. For instance, if each component contributes equally in the system (50%), the EF will be the average of the gas-fired (0.8) and HP efficiency (3.2), or EF=2. Relying on these considerations, for example, it is possible to target a desired energy factor for the overall heat pump water heater, assuming a given gas-fired water heater to be part of the overall system. For example, assume that a gas-fired heat pump water heater system is desired to have an energy factor of 2.0, that the power consumption of the gas-fired water heater (i.e. without consideration of the EF of a heat pump portion of the system) is 5.0 kBTU/hr, that the gas-fired water heater should maintain its contribution at or above 50%, and that the water heater's energy factor is 0.8. Given, and remaining within, these boundary parameters, the system designer makes selections within various of the available heat pump design parameters, such as (a) the compressor size/power consumption needed to move the refrigerant through the refrigerant loop, (b) the refrigerant material, (c) the refrigerant tubing material and dimensions, (d) the heat exchanger configuration between the refrigerant tubing and the tank (e.g. direct wrap or spatially separated exchanger), (e) the heat exchanger configuration between the refrigerant tubing and the flue pipe, and (f) the heat exchanger (in this instance, the evaporator) configuration between the refrigerant and air, to thereby define a heat pump EF and a heat pump power consumption that, by comparison to the water heater power consumption, defines a percentage applied to that heat pump EF in the equation above to result in an overall system EF of 2.0 (or possibly higher). As should be understood in view of the present disclosure, the designer may select instances for these variables through trial and error system selections, modeling each guess to estimate EF and then making changes to the design from the previous guess to move the EF in the desired direction, in order to achieve the desired EF. As will be apparent from the present disclosure, this design procedure is applicable to the embodiment of FIGS. 2 and 3, and also to the other embodiments discussed herein. In these embodiments, the designs are selected so that the overall system EF is greater than 1.0.

Figure 5:
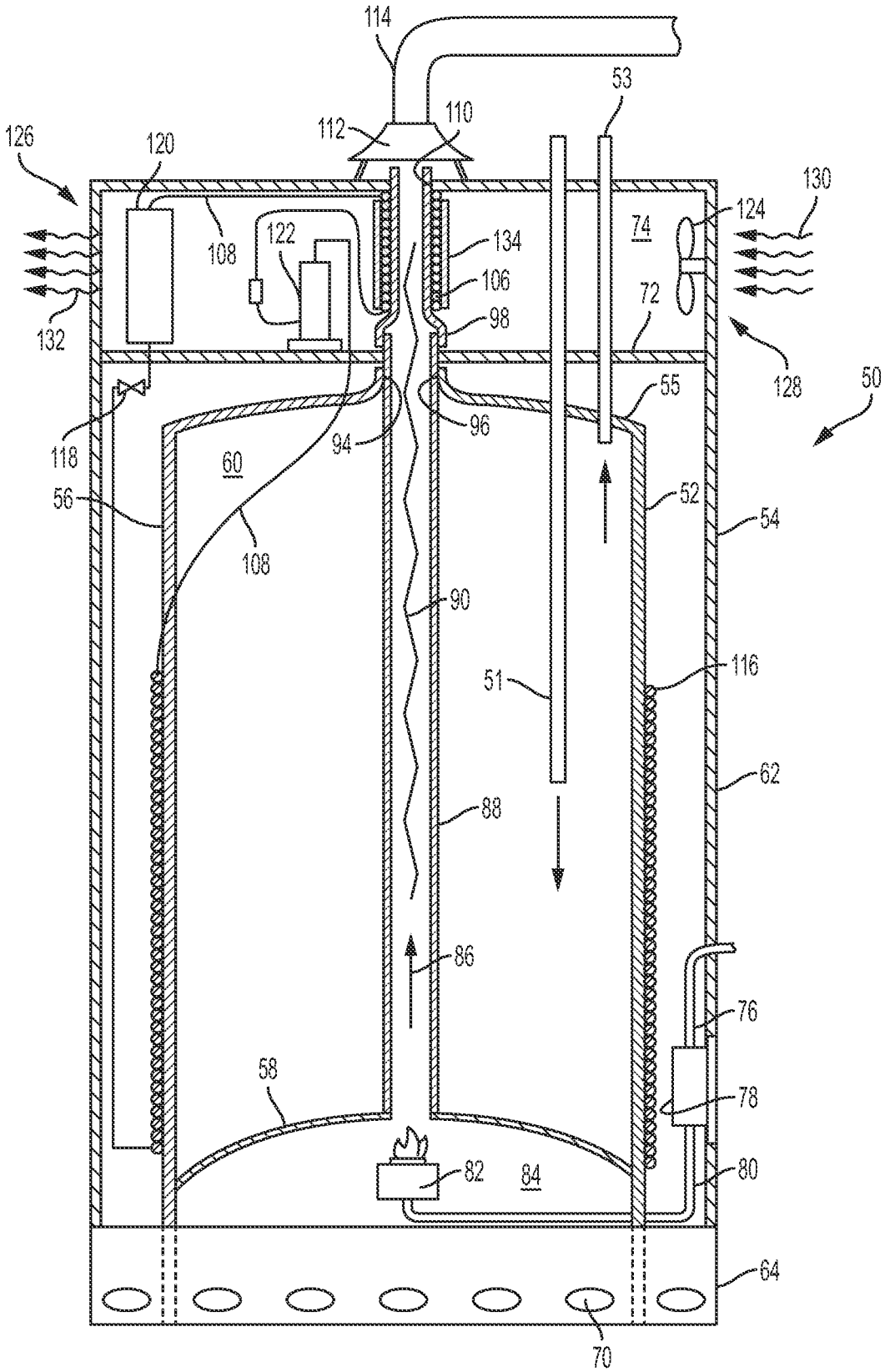
FIG. 5 is a schematic view of a heat pump water heater system in accordance with an embodiment of the present invention.

For example, and referring now to an embodiment illustrated in FIG. 5, it should be understood that refrigerant coil 106 may occupy various positions within the closed refrigerant loop. For example, while coil 106 in the embodiment of FIG. 2 is disposed in the refrigerant flow between compressor 122 and condenser coil 116, coil 106 is disposed in the embodiment of FIG. 5 between evaporator 120 and the compressor.

More specifically, compressor 122 pumps a gaseous refrigerant forward from the compressor, increasing the refrigerant's pressure and temperature and causing the now-hotter refrigerant gas to flow through conduit 108 to condenser coil 116. The refrigerant conduit of coil 116 directly abuts the outer surface of tank body 52, so that the water within tank volume 60 and the refrigerant flowing through the refrigerant conduit are separated only by the walls of tank 52 and conduit 108, each of which is a good conductor of heat. Thus, the refrigerant flowing through coil 116 contributes heat to water within tank 52, via the tank and refrigerant conduit walls.

As the refrigerant moves through condenser coil 116, it condenses to liquid phase. Still under pressure provided by the compressor, the now-liquid refrigerant flows from the output of condenser 116 to expansion valve 118. The expansion valve drops the pressure of the liquid refrigerant as it enters the evaporator coil, within which the refrigerant transitions to gaseous phase, drawing heat energy from the air flowing over the evaporator coil. The now-warmer gaseous refrigerant discharged from evaporator 120 flows to coil 106 wrapped about flue pipe 88. Even though the refrigerant flowing from evaporator 120 has acquired heat from air flow 130/132, the refrigerant is nonetheless cooler than flue gas flowing through flue pipe 88. Thus, the flue gas contributes heat to the refrigerant flowing through coil 106, so that coil 106 and upper portion 102 of heat recovery tube 98 thereby form a heat exchanger. The refrigerant flows from coil 106 to compressor 122, and the cycle repeats. Once again, coil 106 has acquired heat from the flue gas at a point within the refrigerant flow loop that is carried by the refrigerant to the condenser coil and thereby contributes to the water within tank volume 60.

The components of the embodiment of FIG. 5 not specifically discussed are constructed and operate similarly as shown in and discussed with respect to FIG. 2.

In each of the embodiments of FIGS. 2 and 5, coil 106 wrapped about the flue pipe acquires heat from flue gas within flue pipe 88 and contributes that heat to water within tank volume 60 via condenser coil 116. In the embodiment of FIG. 2, the refrigerant flowing through the refrigerant loop defined by conduit 108 acquires the heat from flue pipe 88 immediately prior to flowing to condenser coil 116. In FIG. 5, the flowing refrigerant acquires the flue pipe heat at coil 106 immediately after flowing through the evaporator and immediately before acquiring additional heat at the compressor, but as the refrigerant line is a closed loop, the heat is nonetheless eventually conveyed to condenser coil 116.

Figure 6:
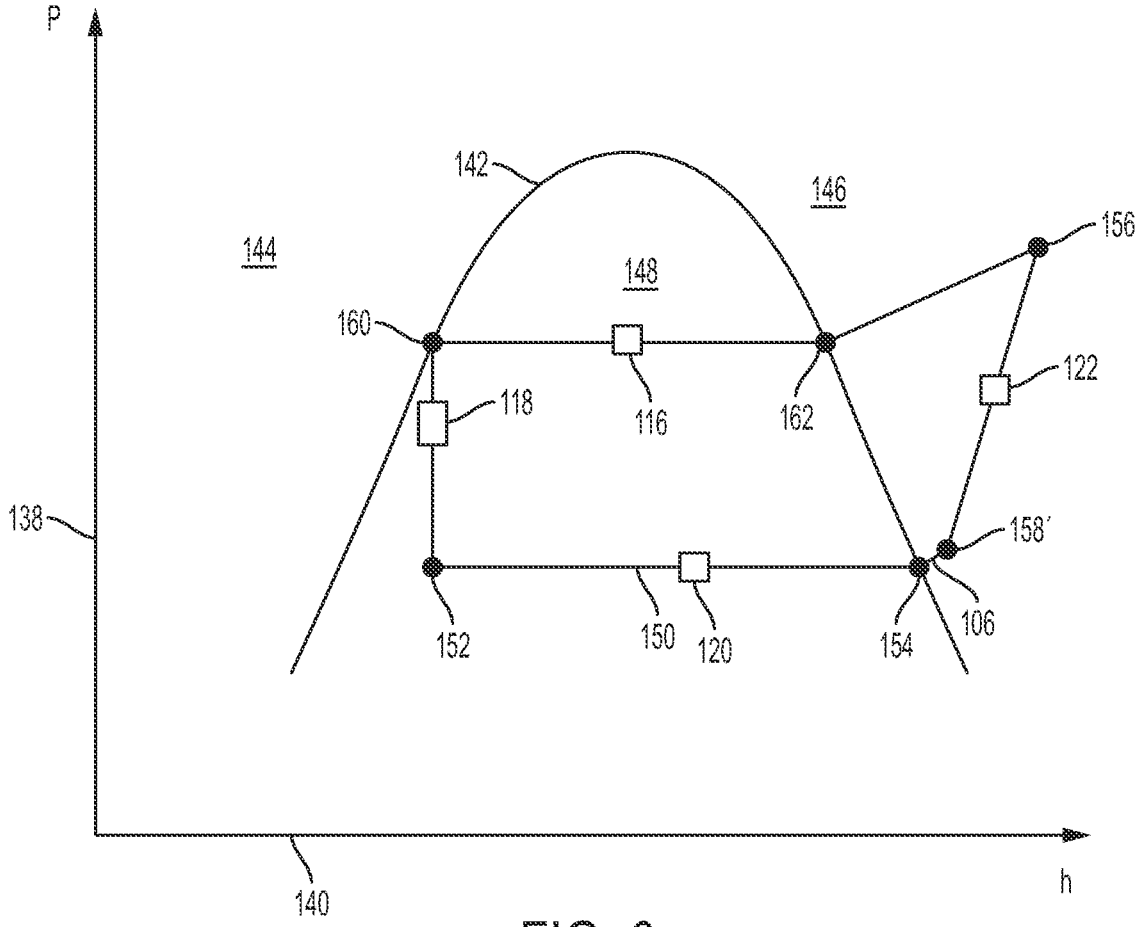
FIG. 6 is a graphical view of a pressure-enthalpy diagram illustrating operation of the heat pump water heater system as in FIG. 5.

FIG. 6 illustrates the operation of heat pump water heater 50, as illustrated in FIG. 5, in terms of a pressure-enthalpy graph. Again, a closed curve 150 describes the refrigerant's pressure/enthalpy state as the refrigerant travels through the closed refrigerant path discussed above with respect to FIG. 5.

For example, a point 152 on curve 150 corresponds to a position in the refrigerant path when the refrigerant leaves expansion valve 118. Here, the refrigerant has the same enthalpy as when it entered the valve, but its pressure has dropped. Maintaining constant enthalpy, its volume increases. Because the refrigerant's energy, or heat, now occupies a larger volume, the refrigerant's temperature is lower, and it more readily accepts latent heat from the air flow as it move through the evaporator. Moving on curve 150 to point 154, the refrigerant has completely evaporated. Because the refrigerant's temperature is near the air temperature in the air flow, little or no sensible heat is thereafter added to the refrigerant from the air flow, and the refrigerant remains at the enthalpy level corresponding to point 154 on curve 150 until the refrigerant exits the evaporator 120 and flows to coil 106.

The increase in enthalpy from point 154 to point 158', however, occurs as the refrigerant moves through coil 106, drawing heat from the flue gas. As noted above, this occurs without significant additional input and energy to the water heater system.

From coil 106, the refrigerant flows to compressor 122. The compressor significantly increases the refrigerant's pressure, as indicated by curve 150 in the transition from point 158' to point 156. From the compressor, the refrigerant flows through the refrigerant path to condenser coil 116.

Figure 7:
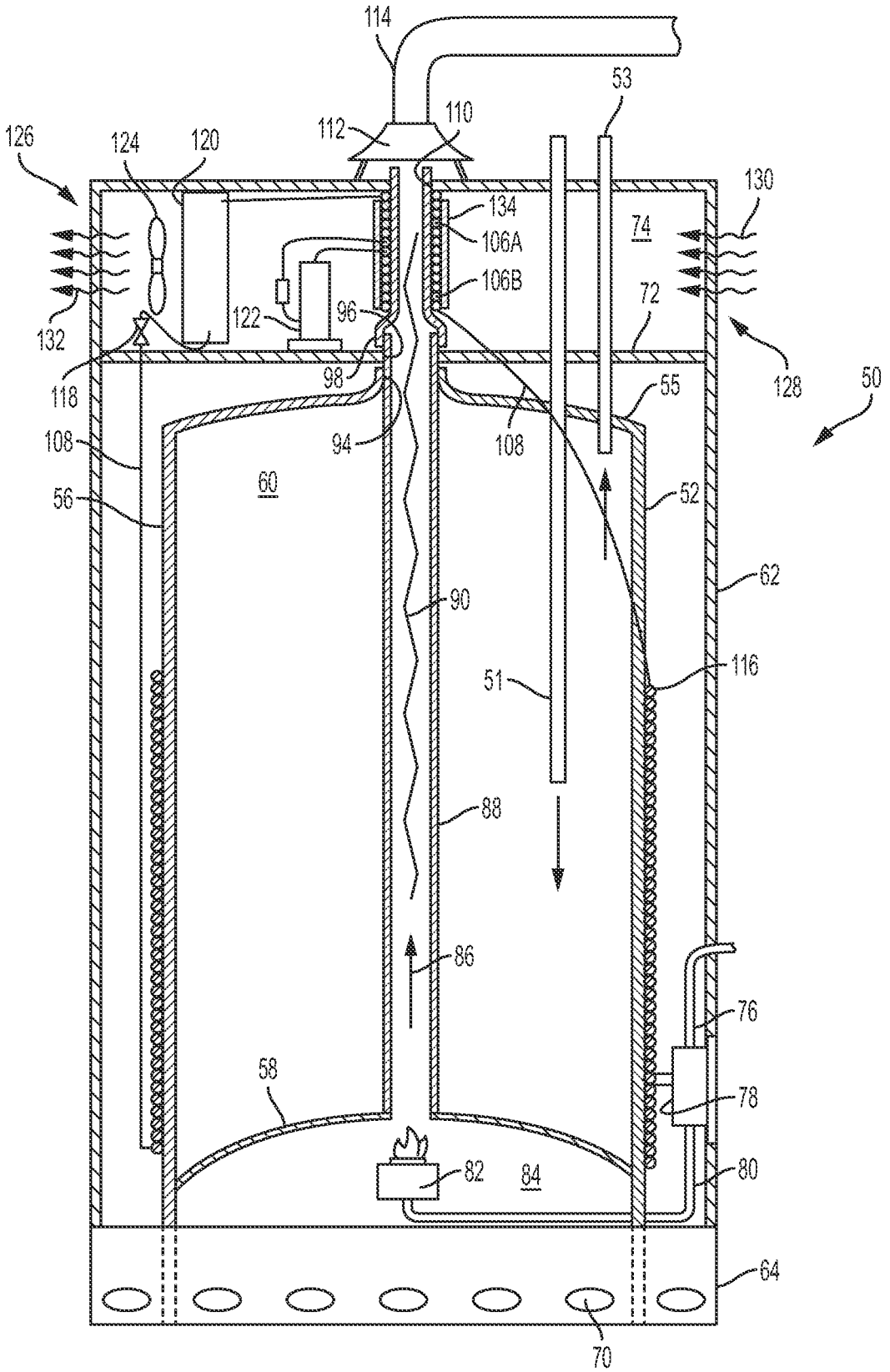
FIG. 7 is a schematic view of a heat pump water heater system in accordance with an embodiment of the present invention.

Referring to the embodiment of a heat pump water heater 50 as illustrated in FIG. 7, coil 106 is formed in two parts, as indicated at 106A and 106B, disposed in the closed refrigerant flow loop on opposite sides of compressor 122. More specifically, compressor 122 pumps gaseous refrigerant forward from the compressor, increasing the refrigerant's pressure and temperature and causing the hot refrigerant gas to flow through refrigerant conduit 108 to coil portion 106B wrapped about flue pipe 88. The refrigerant, while hot, is cooler than the flue gas in pipe 88. Thus, flue gas within pipe 88 contributes heat to the refrigerant flowing through coil portion 106B.

From coil portion 106B, the refrigerant conduit continues to condenser coil 116, at which point the refrigerant contributes heat from the refrigerant path to the water within tank volume 60, as described above. As the refrigerant moves through the condenser coil, it condenses to liquid phase. Still under pressure provided by compressor 122, the now-liquid refrigerant flows from the output of condenser 116 to expansion valve 118. The expansion valve drops the pressure of the liquid refrigerant as it enters evaporator coil 120. Within the evaporator, the refrigerant transitions to gaseous phase, drawing heat energy from air flowing over the evaporator coil.

The now-warmer gaseous refrigerant discharged from evaporator 120 then flows to coil portion 106A. Again, flue gas within pipe 88 contributes heat to the refrigerant flowing through coil portion 106A. From portion 106A, the refrigerant returns to compressor 122, and the cycle repeats.

Figure 8:
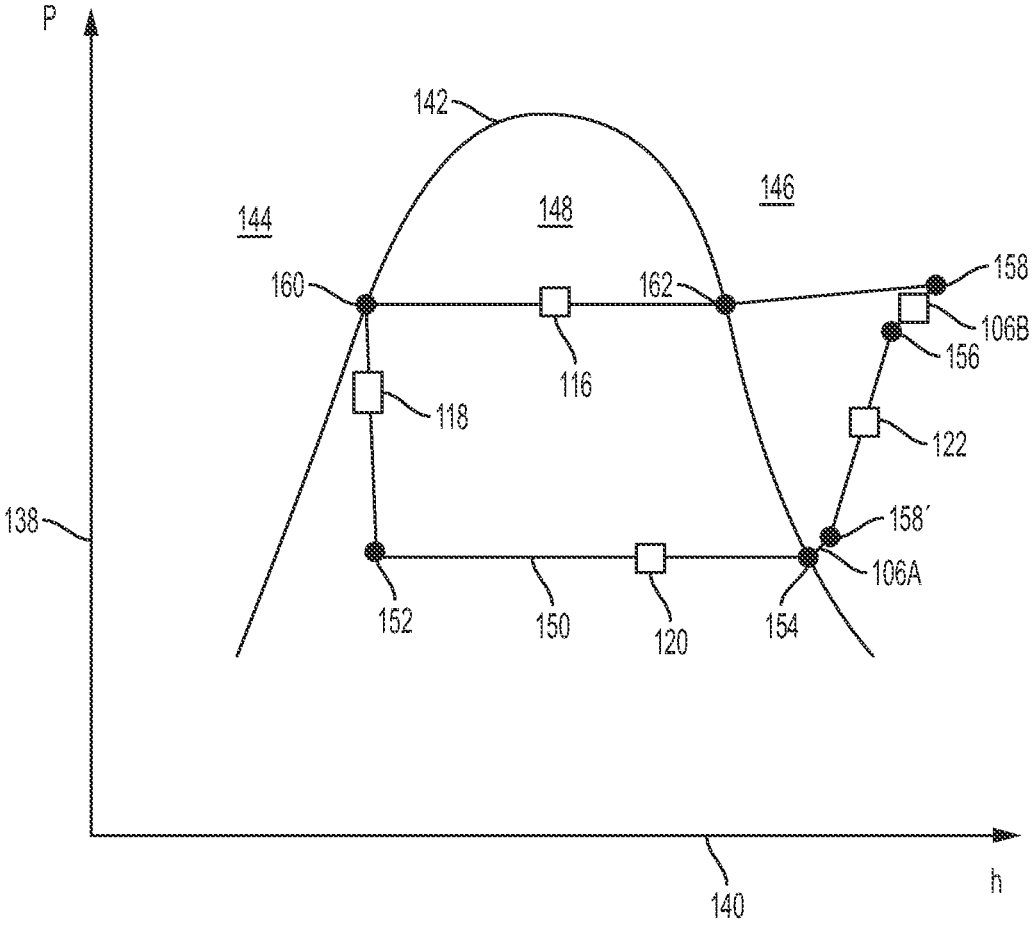
FIG. 8 is a graphical illustration of a pressure-enthalpy diagram illustrating operation of the heat pump water heater system as in FIG. 7.

FIG. 8 illustrates the operation of the heat pump water heater 50 of FIG. 7 in terms of a pressure-enthalpy graph. Again, closed curve 150 describes the refrigerant's pressure/enthalpy state as the refrigerant travels through the closed refrigerant path discussed above with respect to FIG. 7.

For example, point 152 on curve 150 corresponds to a position in the refrigerant path when the refrigerant leaves expansion valve 118. Because the refrigerant's energy, or heat, now occupies a larger volume, the refrigerant's temperature is lower, and the refrigerant more readily accepts latent heat from the air flow as it moves through the evaporator. Moving on curve 150 to point 154, the refrigerant has completely evaporated to gaseous form. The refrigerant being in an entirely gaseous phase at point 154 and reaching a temperature near the air temperature in the air flow, little or no sensible heat is added to the refrigerant from the air flow as the refrigerant continues to flow through the evaporator. The refrigerant therefore remains at the enthalpy level corresponding to point 154 on curve 150 until the refrigerant exits evaporator 120, flows through the following refrigerant path, and reaches coil portion 106A around the flue pipe. Because the exhaust gas in the flue pipe is at a temperature greater than the refrigerant temperature, this transfers heat to the refrigerant, indicated in the enthalpy diagram by the movement from point 154 to 158'. Note that the temperature increases also causes an increase in pressure.

The compressor significantly increases the refrigerant's pressure, as indicated by curve 150 in the transition from point 158' to point 156. From the compressor, refrigerant flows to second coil portion 106B, at which the refrigerant acquires additional heat from the flue gas, as indicated in the enthalpy transition from point 156 to point 158 on curve 150. Thus, the enthalpy increase from point 154 to point 158', and from point 156 to 158, represents energy added to the refrigerant without requiring additional fuel energy input.

From flue pipe coil portion 106B, the refrigerant flows through the refrigerant path to condenser coil 116. The refrigerant loses some heat in that travel, though relatively little. In that regard, and as indicated in the Figures, insulation may be provided around the tubing to reduce the effect. When the tubing reaches and abuts the water heater wall, the much lower temperature of the tank water, given the thermal conductivities of the tank wall and the tubing wall, causes heat transfer from the refrigerant to the tank water. This is reflected in curve 150 in the enthalpy drop between points 158 and 160, with the refrigerant beginning to condense into liquid at point 162. At point 160, the refrigerant temperature is below the water temperature, and further energy contribution from the now-fully liquid refrigerant does not occur. The refrigerant then travels to the expansion valve, to reduce its pressure and thereby facilitate its acceptance of energy from the air flow, and the cycles continues.

Figure 9:
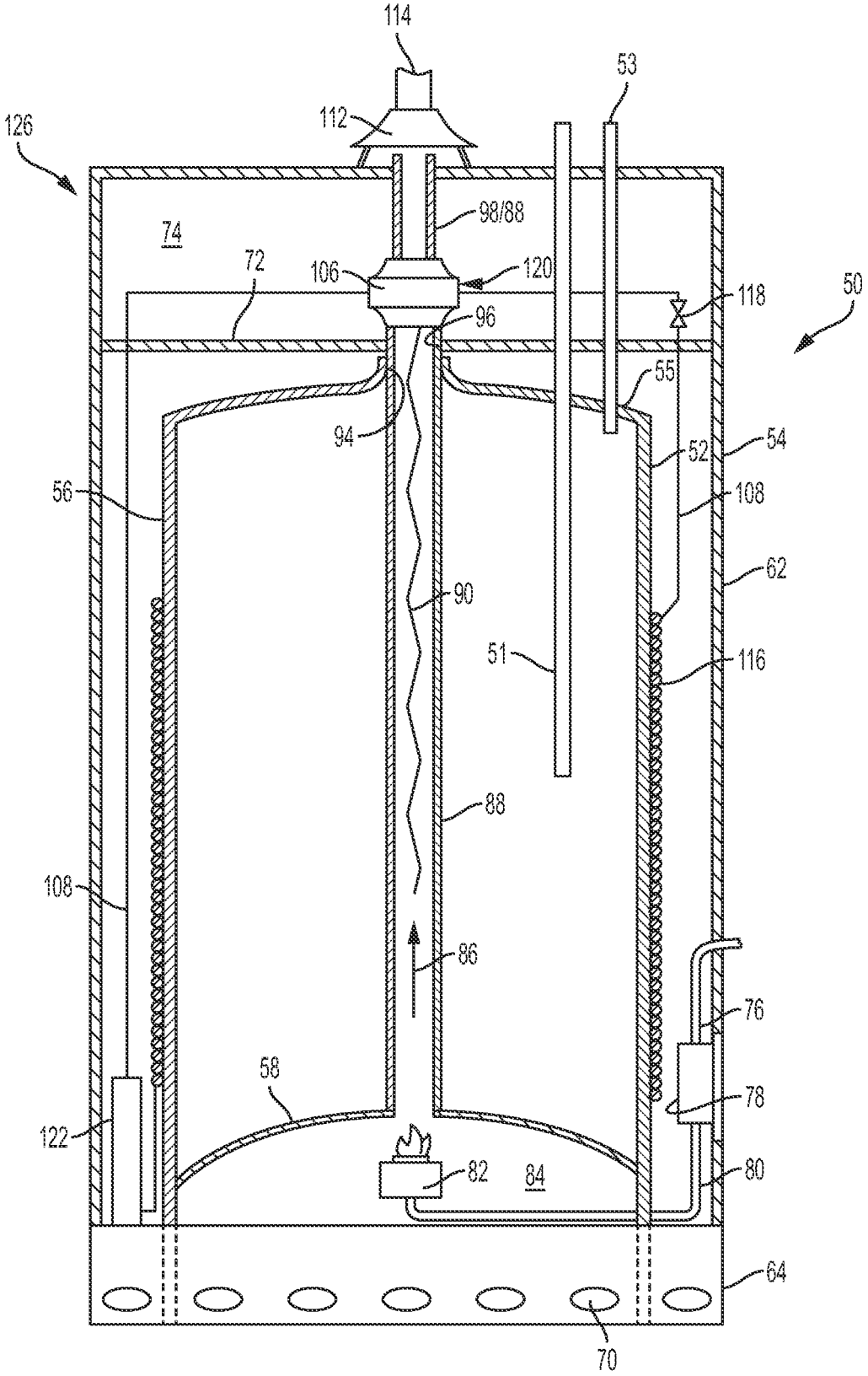
FIG. 9 is a schematic view of a heat pump water heater system in accordance with an embodiment of the present invention.

Referring now to FIG. 9, it should also be understood that the components of heat pump water heater 50 may be accommodated in different positions within the system and within housing 54. It will be appreciated, for example, that in some embodiments, it may be desirable not to place the compressor in the upper portion of the water heater housing. Accordingly, compressor 122 is disposed in the embodiment of FIG. 9 at a floor of outer housing 54 between tank wall 56 and outer housing side wall 62. The compressor remains, however, a part of the closed refrigerant path loop, and in particular is disposed in the refrigerant flow between condenser coil 116 and evaporator 120. Having removed compressor 122 from upper housing volumes 74, however, an air flow passing through volume 74 would not acquire heat from the compressor, as is the case with the above-described embodiments, and the fan is omitted from this example. To provide sufficient heat to the refrigerant in the evaporator sequence, therefore, the embodiment of FIG. 9 disposes the evaporator so that the evaporator coils wrap about flue pipe 98/88. That is, rather than separating the evaporator/flue-heat absorption process in a distinct evaporator 120 and flue coil 106 as in the embodiments of FIGS. 2, 5, and 7, the embodiment of FIG. 9 utilizes a single coil, as indicated by references 106 and 120 to the same coil structure in the Figure. Evaporator 120/106 may comprise an outer housing (indicated at 120) within which is disposed aluminum tubing (indicated by reference 106) wrapped about flue pipe 98/88, which extends through the center of the evaporator. Fins are not provided on the wrapped coil, in that no air passes through the evaporator. By designing sufficient surface area contact between the evaporator coil and flue pipe 98/88, the portion of the refrigerant path coil indicated at 120 acquires sufficient energy from the flue gas to perform the evaporation function. This, in turn, may obviate the need for a fan in the upper chamber, if the natural flow, or draft rate, of flue gas is sufficient to provide such sufficient heat to the refrigerant via the heat exchanger. In a still further embodiment, however, a fan is provided in line with or above the end of flue pipe 98/88, above heat exchanger 120/106, to draw hot flue gas up through the heat exchanger at a higher rate. The fan may also be placed in-line in the flue pipe below the heat exchanger to push hot flue gas up through the heat exchanger.

It should be understood that various other embodiments may be practiced within the scope of the present invention. For instance, each of the embodiments described above defines the condenser as a coil wrapped around the exterior of the water tank. In still further embodiments, however, the refrigerant conduit does not wrap around the tank but is, instead, part of a heat exchanger that is spatially removed from the tank surface. A second conduit line extends from the tank interior volume to this heat exchanger, and from the heat exchanger back to the tank. That is, the conduit forms a closed fluid path for water from the tank to flow through the heat exchanger, and a pump may be provided to move the water through that path. The water line and the refrigerant line are in sufficient proximity within the heat exchanger so that the hot refrigerant conveys heat to water circulating through the closed water flow path. In further embodiments, the refrigerant path extends into the tank interior, and for example the refrigerant tubing within the tank volume is of a double-walled construction. In these manners, the refrigerant path is in thermal communication with the water tank, including the water tank volume, so that heat transfers from the refrigerant to the water tank volume when refrigerant flows through the refrigerant path. In still further embodiments, the refrigerant path is in thermal communication with the flue, not by (or entirely by) wrapping the refrigerant tubing around the flue pipe, but instead (or additionally) by extending the refrigerant tubing through the flue pipe wall so that the refrigerant tubing is in direct thermal contact with the exhaust gas.

Modifications and variations to the particular embodiments of the present invention may be practiced by those of ordinary skill in the art, without departing from the spirit and scope of the present invention, which is more particularly set forth in the appended claims. In addition, it should be understood that aspects of the various embodiments maybe interchanged as in whole or in part. Furthermore, those of ordinary skill in the art will appreciate that the foregoing description is by way of example only and is not intended to limit the invention so further described in the appended claims.

What is claimed is:

1. A heat pump water heater, comprising:

a tank defining a water tank volume for retaining water;

a burner in communication with a fuel source and proximate the tank so that combustion of fuel from the source at the burner generates heat that transfers to the water tank volume;

a flue pipe defining a flue volume, the flue pipe having a first section extending from an area in which the burner is disposed to a top wall of the tank, a portion of the first section extending through the top wall of the tank, and a second section affixed to the portion of the first section extending through the top wall of the tank, the second section extending to an area ambient the tank so that the flue pipe conveys exhaust gas resulting from the combustion to the ambient area; and a heat pump system comprising:

a refrigerant path having:

a first portion comprising a refrigerant conduit that is disposed between a pump and a condenser and configured to transfer refrigerant from the pump to the condenser, wherein at least a portion of the first portion is a coil wrapped around the second section of the flue pipe such that a wall of the coil is in direct contact with an outer surface of the second section of the flue pipe such that the portion of the first portion is in thermal communication with the second section of the flue pipe to transfer heat from the exhaust gas in the flue volume to the refrigerant flowing through the portion of the first portion, and a second portion in thermal communication with the tank so that heat transfers from the refrigerant flowing through the second portion to the water tank volume when the refrigerant flows through the second portion and the water tank volume retains water, wherein the pump is disposed in the refrigerant path between an evaporator and the coil of the first portion and is actuatable to move the refrigerant through the refrigerant path.

2. The heat pump water heater as in claim 1, having an energy factor greater than 1.0.

3. The heat pump water heater as in claim 1, wherein the second portion comprises the condenser of the heat pump.

4. The heat pump water heater as in claim 1, further comprising an expansion valve in the refrigerant path, and wherein the pump is disposed in the refrigerant path between the expansion valve and at least a portion of the first portion.

5. A heat pump water heater, comprising:

a tank defining a water tank volume for retaining water;

a burner in communication with a fuel source and proximate the tank so that combustion of fuel from the source at the burner generates heat that transfers to the water tank volume;

a flue pipe defining a flue volume, the flue pipe having a first section extending from an area in which the burner is disposed to a top wall of the tank, a portion of the first section extending through the top wall of the tank, and a second section affixed to the portion of the first section extending through the top wall of the tank, the second section extending to an area ambient the tank so that the flue pipe conveys exhaust gas resulting from the combustion to the ambient area; and a heat pump system comprising:

a fan actuatable to move air in an air flow path, a refrigerant path having:

a first portion that passes through the air flow path, a second portion comprising a refrigerant conduit that is disposed between a pump and a condenser and configured to transfer refrigerant from the pump to the condenser, wherein at least a portion of the second portion is a coil wrapped around the second section of the flue pipe such that a wall of the coil is in direct contact with an outer surface of the second section of the flue pipe such that the portion of the second portion is in thermal communication with the second section of the flue pipe to transfer heat from the exhaust gas in the flue volume to refrigerant flowing through the portion of the second portion, and a third portion comprising the condenser that is in thermal communication with the tank so that heat transfers from the refrigerant flowing through the third portion to the water tank volume when the refrigerant flows through the third portion and the water tank volume retains water, wherein the pump is disposed in the refrigerant path between the first portion and the coil of the second portion and is actuatable to move refrigerant through the refrigerant path.

6. The heat pump water heater as in claim 5, having an energy factor greater than 1.0.

7. The heat pump water heater as in claim 5, wherein the first portion serves as an evaporator of the heat pump.

8. The heat pump water heater as in claim 5, wherein the first portion comprises a tubing coil of an evaporator that is disposed within the air flow path, and wherein the refrigerant path comprises an expansion valve through which refrigerant flows to the evaporator.

9. The heat pump water heater as in claim 5, wherein the third portion is adjacent an exterior surface of the tank.

10. The heat pump water heater as in claim 9, wherein the third portion is a section of tubing wrapped around the exterior surface of the tank.

11. A heat pump water heater, comprising:

a housing having a first portion including a tank defining a water tank volume for retaining water and a second portion;

a burner in communication with a fuel source and proximate the tank so that combustion of fuel from the source at the burner generates heat that transfers to the water tank volume;

a flue pipe defining a flue volume extending from an area in which the burner is disposed to an area ambient the tank so that the flue pipe conveys exhaust gas resulting from the combustion to the ambient area; and a heat pump system comprising:

a fan actuatable to move air across the second portion of the housing in a horizontal air flow path, the second portion of the housing including at least a portion of the flue pipe, an evaporator, and a pump, a refrigerant path having:

a first portion comprising the evaporator disposed in the air flow path, a second portion comprising a refrigerant conduit that is disposed between the pump and a condenser and configured to transfer refrigerant from the pump to the condenser, wherein at least a portion of the second portion is a coil wrapped around the flue pipe such that a wall of the coil is in direct contact with an outer surface of the flue pipe so that heat transfers from the exhaust gas in the flue volume to the refrigerant flowing through the portion of the second portion, and a third portion comprising the condenser that is adjacent the tank so that heat transfers from the refrigerant flowing through the condenser to the water tank volume when the refrigerant flows through the condenser and the water tank volume retains water, and an expansion valve through which the refrigerant flows to the evaporator, wherein the pump is disposed in the refrigerant path between the first portion and the coil of the second portion and is actuatable to move refrigerant through the refrigerant path.

12. The heat pump water heater as in claim 11, having an energy factor greater than 1.0.

13. A method of constructing a heat pump water heater having a tank of a predetermined size that defines a water tank volume for retaining water, a burner of a predetermined power consumption, the burner being in communication with a fuel source and proximate the tank so that combustion of fuel from the source at the burner generates heat that transfers to the water tank volume, and a flue pipe defining a flue volume, the flue pipe having a first section extending from an area in which the burner is disposed to a top wall of the tank, a portion of the first section extending through the top wall of the tank, and a second section affixed to the portion of the first section extending through the top wall of the tank, the second section extending to an area ambient the tank so that the flue pipe conveys exhaust gas resulting from the combustion to the ambient area, the method comprising:

providing a refrigerant path having:

a first portion that passes through an air flow path, a second portion comprising a refrigerant conduit that is disposed between a pump and a condenser and configured to transfer refrigerant from the pump to the condenser, wherein at least a portion of the second portion is a coil wrapped around the second section of the flue pipe such that a wall of the coil is in direct contact with an outer surface of the second section of the flue pipe so that heat transfers from the exhaust gas in the flue volume to the refrigerant flowing through the portion of the second portion, and a third portion in thermal communication with the tank so that heat transfers from refrigerant flowing through the third portion to the water tank volume when the refrigerant flows through the third portion and the water tank volume retains water; and providing the pump disposed in the refrigerant path between the first portion and the coil of the second portion and actuatable to move the refrigerant through the refrigerant path, so that the heat pump water heater has an energy factor greater than 1.0.

* * * * *